United States Patent [19]

Theunissen

[11] 4,113,195

[45] Sep. 12, 1978

[54] DISPENSING DEVICE FOR WEB MATERIAL IN ROLL FORM

[75] Inventor: Eos Lee Theunissen, Johannesburg, South Africa

[73] Assignee: Manfred Sidley, Sandton, South Africa

[21] Appl. No.: 744,544

[22] Filed: Nov. 24, 1976

[51] Int. Cl.[2] ..... B65H 19/04

[52] U.S. Cl. ..... 242/55.3; 242/55.53

[58] Field of Search ..... 242/55.3, 55.53, 134, 242/137, 141; 225/46, 47, 51–56; 312/39–41, 45; 206/389, 397–409, 824

[56] References Cited

U.S. PATENT DOCUMENTS

| | | | |
|---|---|---|---|
| 1,168,703 | 1/1916 | Bauer | 242/55.53 |
| 1,809,029 | 6/1931 | Fulcher | 242/141 |
| 2,550,927 | 5/1951 | Jurnove et al. | 242/138 |
| 3,295,777 | 1/1967 | Carroll | 242/55.3 |
| 3,316,040 | 4/1967 | McGann | 312/45 |

*Primary Examiner*—Leonard D. Christian

*Attorney, Agent, or Firm*—Pollock, Vande Sande & Priddy

[57] ABSTRACT

This invention is concerned with the provision of a dispensing device for material in roll form which is designed to minimize the chances of pilfering taking place, the device in its preferred form having a cylindrical housing for one or more rolls in end to end relationship, an inlet at one end for rolls to enter the housing in an axial sense, one-way security means preventing removal of the roll from the housing through the inlet, and in the housing a dispensing aperture through which the material may be drawn off in sheet form but through which the roll itself cannot be removed until substantially all of the material has been removed therefrom.

6 Claims, 2 Drawing Figures

DISPENSING DEVICE FOR WEB MATERIAL IN ROLL FORM

This invention relates to devices for dispensing paper and the like from rolls thereof. The word 'paper' will be used in this specification to cover sheets or films of various synthetic resinous and other materials which are often provided in roll form, in addition to conventional toilet and like rolls.

Conventional toilet roll dispensing devices often fail to provide adequate protection against pilfering, and an object of the present invention is the provision of a dispensing device in which pilfering is minimized.

According to the invention, such a device includes a housing, an inlet to the housing for a roll to be passed into the housing, security means at or adjacent the inlet which acts to prevent withdrawal of a roll from the housing through the inlet, and at least one dispensing aperture in the housing through which paper may be withdrawn from a roll in the housing, the aperture being adapted to prevent removal of the roll itself at least when substantially charged with paper.

In a preferred form of the invention, the security means is a series of circumferentially spaced fingers spring biased in a radially inward direction.

A further feature of a preferred form of the invention is the provision of a tubular bore in the housing which accommodates at least two rolls in end-to-end relationship, the trailing roll being held in reserve and acting to block the inlet to the bore against removal of the rolls therethrough.

The invention also contemplates the provision of two side-by-side circumferentially disposed dispensing apertures or slots so dimensioned as to facilitate maneuvering of the roll for dispensing purposes or for removal of a spent core of the roll, but having circumferential dimensions such that a substantially charged roll may not be removed through the apertures.

To facilitate movement of a reserve roll forwardly into the dispensing position, the housing may be slotted to permit a finger to be inserted to urge the roll forwardly.

Figure 1:
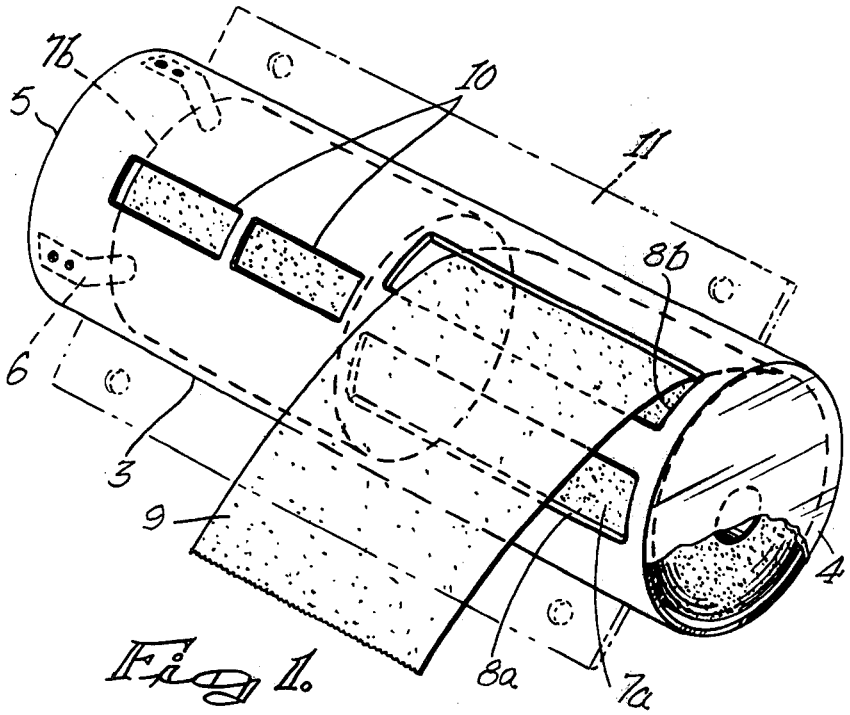
Figure 2:
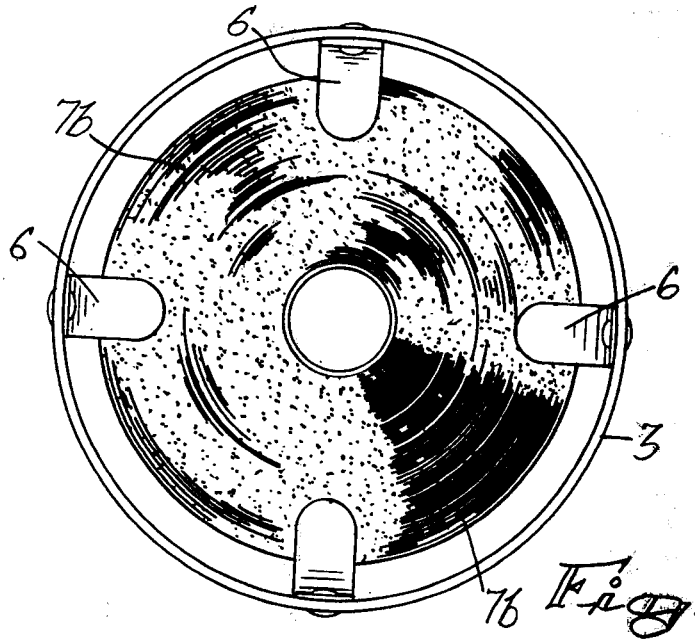

In order to illustrate the invention, some examples are described hereunder with reference to the accompanying drawings in which:

FIG. 1 is a perspective view of one form of dispenser according to the invention, and FIG. 2 is an end view thereof.

Referring to the drawings, the dispenser includes a tubular housing 3 made of suitable material, such as synthetic resinous material, closed at its end 4 but open at its end 5 to provide an inlet to the bore therein. At the inlet 5, inwardly spring-biased fingers 6 are provided, spaced apart as shown, and these fingers readily permit the bore of the housing to be loaded with charged paper rolls 7, but act to prevent withdrawal of a roll from the housing through the inlet.

The leading roll **7*a* is located adjacent dispensing apertures 8*a* and 8*b* which are so dimensioned that fingers may be inserted to assist in dispensing paper from roll 7*a* and also for the removal of the roll core as normally provided. The circumferential dimensions of these apertures is such, on the other hand, that the removal of a relatively charged roll therethrough is not possible. FIG. 1 clearly illustrates how paper 9 may be removed from the roll 7*a* and either of the apertures 8*a* or 8*b*** may be used for this purpose. In the drawing, paper is shown drawn from the top of the roll, but advantages could be derived by drawing the paper from the bottom of the roll.

Slots 10 are provided in housing 3 merely to facilitate the movement of the reserve roll **7*b* to the operative dispensing position when used roll 7*a*** is removed from the housing.

Any suitable bracket arrangement 11 may be employed for securing the dispenser to a suitable foundation, and it is for this reason that the bracket illustrated has merely been shown in ghost line.

Many more examples of the invention exist, each differing from the other in matters of detail only. In more complex arrangements of the invention, a mandrel may be employed, but in the actual embodiment under discussion a mandrel is not required at all, and hence the general structure illustrated is simplicity itself. The absence of a mandrel adds a useful feature in that the roll may rest on the floor of the housing and this frictional engagement will act to prevent or inhibit to any material degree free rolling of the roll itself during a dispensing step. By use of the reserve roll or rolls, pilfering through the inlet should be substantially minimized, since this roll will always be of maximum diameter, so that its removal past the fingers 6 should be virtually impossible. Where only one roll is used, the danger exists that, when its diameter has been reduced substantially, its withdrawal past the fingers might be possible. However, even in these latter circumstances the design of the fingers could be such as to require large scale removal of paper from the roll before its removal past the fingers becomes possible.

What is claimed:

1. A device adapted for dispensing web material from rolls thereof, including a housing defining a tubular bore in which at least one roll may be located, said bore being closed at one end and providing an inlet at its other end whereby a roll may be moved into said bore in an axial direction, security means at or adjacent said inlet extending axially relative to said bore of said housing, said means having a diameter progressively narrowing in the direction of movement of said roll into said housing, the narrowest part of said means being of a diameter smaller than that of a said roll at least when substantially charged with material, and at least one dispensing aperture in said housing through which material may be tangentially withdrawn from a said roll in said bore of said housing said aperture being adapted to prevent removal of said roll itself at least when substantially charged with material.

2. The device claimed in claim 1, in which said security means comprises a plurality of circumferentially spaced fingers spring biased in a radially inward direction to prevent withdrawal of a said roll from said housing through said inlet.

3. The device claimed in claim 2, in which two dispensing apertures are provided in the bore wall in side-by-side circumferentially disposed relationship, the apertures being arranged to facilitate maneuvering of the roll in the course of dispensing material therefrom and for the removal of a spent core of the roll.

4. The device claimed in claim 3, in which the bore in the housing is long enough to accommodate a reserve roll in trailing relationship to the roll in use.

5. A device adapted for dispensing web material from rolls thereof, including a housing defining a tubular bore in which at least one roll may be located, said bore being closed at one end and providing an inlet at its other end whereby a said roll may be moved into said bore in an axial direction, security means at or adjacent said inlet comprising means extending axially relative to said bore of said housing, said means having a diameter progressively narrowing in the direction of movement of a said roll into said housing, the narrowest part of said means being of a diameter smaller than that of said roll at least when substantially charged with material, and two dispensing apertures in the bore wall in side-by-side circumferentially disposed relationship, the apertures being arranged to facilitate maneuvering of the roll in the course of tangentially dispensing material therefrom and for the removal of a spent core of the roll.

6. The device claimed in claim 5, in which the bore in the housing is long enough to accommodate a reserve roll in trailing relationship to the roll in use.

* * * * *